United States Patent [19]

Stanton

[11] 4,429,882

[45] Feb. 7, 1984

[54] GOLF PUTTING TARGET

[76] Inventor: Robert Stanton, Rte. 44, Millbrook, N.Y. 12545

[21] Appl. No.: 429,066

[22] Filed: Sep. 30, 1982

[51] Int. Cl.[3] ..... A63B 69/36

[52] U.S. Cl. ..... 273/177 R

[58] Field of Search ..... 273/177 R, 177 A, 177 B, 273/178 R, 178 A, 178 B, 179 R, 179 A, 179 B, 179 C, 179 D, 179 E, 176 B, 180

[56] References Cited

U.S. PATENT DOCUMENTS 884,277 4/1908 Hughes ..... 273/178 R 3,424,463 1/1969 Matthews ..... 273/179 C

*Primary Examiner*—George J. Marlo

[57] ABSTRACT

A golf putting target with a circular base the size of a real hole in a green has an upward slanting ramp towards a vertical wall at the back of the base. Downward sloping ramps are formed on either side of a center line towards the side of the base, the vertical wall decreasing in height towards the upper surface of the downward sloping ramps. The base increases in thickness along the center line and includes a flat ramp decreasing in width from the front to the back of the base.

2 Claims, 4 Drawing Figures

GOLF PUTTING TARGET

TECHNICAL FIELD

This invention relates to a practice putting target, and more particularly to a target having dimensions the same as a real hole in the green of a golf course, and providing a configuration to deflect previously putted balls from the line of subsequently putted balls.

BACKGROUND ART

Previous golf putting practice targets placed on a floor of a room for practice putting are configured in such a way that their size is substantially greater than the diameter of a hole in the green of a golf course. These devices provide a false indication of the accuracy of a practice putt by collecting balls previously putted which would normally have missed a regularly sized hole. Further, many practice putting devices accumulate previously putted balls to the point where subsequent balls could not be captured. Also inaccurate putts or even accurate putts will tend to cause previously putted balls to accumulate in the line of subsequent putts and therefore prevent accurate putts from reaching the target.

SUMMARY OF THE INVENTION

A feature of the practice putting target of the present invention is that it provides a target having the same size as a real hole in the green of a golf course. An additional object and feature of the invention is to provide a configuration of a golf putting target that causes previously putted balls to be deflected from the path of subsequently putted balls both when putts are accurate or inaccurate.

These and other features and advantages are realized in a golf putting target comprised of a circular base having a diameter the same as a hole in the green of a golf course. Integral with the base, and at the back thereof, is a vertical wall which extends partially around the circumference of the base. The thickness of the base, from front to back, increases along a center line which corresponds to the line of an accurate putt and creates an upward sloping ramp. The height of the vertical wall at the back of the base, and at the center line, has a height approximately equal to one-half the diameter of a golf ball. The height of the vertical wall decreases on either side of the center line, and along the circumference of the base, to a point on the circumference corresponding approximately to a diameter of the base. At the rear of the base, and where the thickness is greatest, downward sloping ramps are formed towards the low point of the vertical wall. The downward sloping ramps have a slightly concave upper surface.

DETAILED DESCRIPTION OF THE INVENTION

Figure 1:
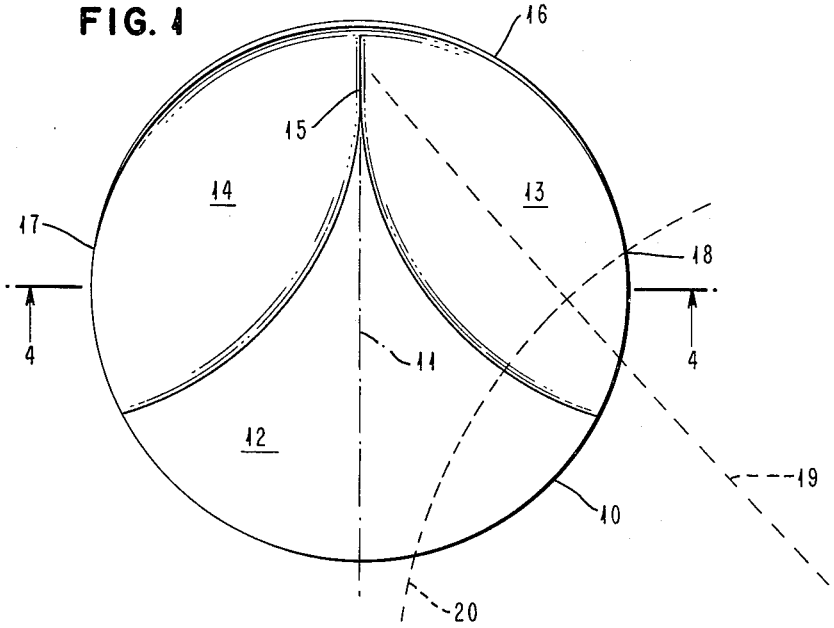
FIG. 1 is a plan view of the golf putting target of the present invention.
Figure 2:
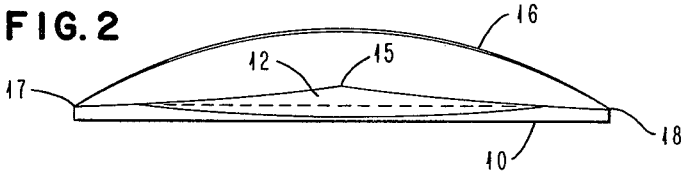
FIG. 2 is a front elevation view of the golf putting target of the present invention.
Figure 3:
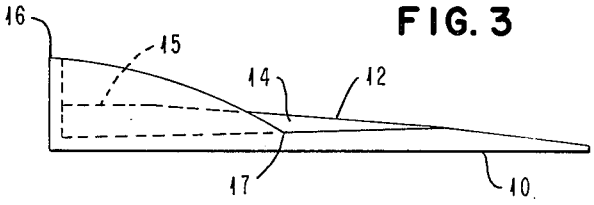
FIG. 3 is a side elevation view of the golf putting target of the present invention.

FIGS. 1, 2 and 3, all have the same numeric designation for the same part of the present invention, and will be utilized in the description.

The golf putting target of the present invention is comprised of a base 10 which has increasing thickness along a center line 11 which corresponds to the line of a perfectly putted ball to the target. The increasing thickness of the base 10, along the center line 11, creates an upward slanting ramp 12 from the front of the base 13 to the rear of the base 14.

Figure 4:
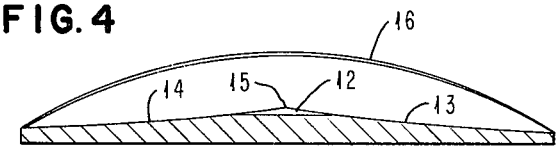
FIG. 4 is a sectional view 4—4 of FIG. 1.

On either side of the center line 11, and at the rear 14 of the base 10, a portion of the upward slanting ramp surface 12 is cut away to create downward slanting ramps 13 and 14. As shown in FIG. 4, the downward slanting ramps 13 and 14 have a slight concave configuration on their upper surface. The formation of the downward slanting ramps 13 and 14 creates, at the upper portion of the upward slanting ramp 12, a ridge 15.

At the back of the base 10, an integral vertical wall 16 is provided. The height of the wall 16 is decreased on either side of the center line 11 around the circumference of the base 10 to points 17 and 18 coextensive with the upper surface of the downward slanting ramps 13 and 14.

In use, a golf ball putted along the center line 11 representing an accurate putt, will travel up the upward slanting ramp surface 12, contact the wall 16, and roll off either side of the ridge 15 down the downward sloping ramps 13 or 14 along a path such as 19. This then causes an accurately putted ball to be deflected along the path 19 to a point where it will not be in the path of subsequently putted balls.

In a like manner, an inaccurately putted ball shown along the path 20 will traverse a path up a portion of the upward slanting ramp 12 and be deflected over the vertical wall 16 at its low point 18, and thus also be deflected out of the path of subsequently putted balls. It has also been found that a ball putted along the center line 11 with too much speed will jump over the vertical wall 16 if its height, measured from the ridge 15 to the top, is slightly less than one-half the diameter of a golf ball.

There has thus been shown a golf putting target which provides an accurate judge of accuracy in view of its dimension being substantially the same as that of a hole in the green of a golf course. Also, the configuration is such that balls previously putted will be deflected out of the path of subsequently putted balls.

Having thus described my invention, what I claim as new, and desire to secure by Letters Patent is:

1. A golf putting target comprising:

a solid circular base;

a vertical back wall integral with said base and extending around a portion of the circumference of said base;

said base having increasing thickness from the front thereof to the back along a center line corresponding with the path of a properly putted golf ball and forming an upward slanting flat ramp, said ramp decreasing in width from the front of said base to the back; and a downward sloping ramp on both sides of said center line from the top of said upward slanting ramp on said base to the side of said base, whereby the intersection of said upward slanting flat ramp and said downward sloping ramps form a ridge along said center line.

2. A golf putting target in accordance with claim 1 wherein said downward sloping ramp on either side of said center line has a slight concave upper surface.

* * * * *